US011638508B2

(12) United States Patent
Gottschall

(10) Patent No.: US 11,638,508 B2
(45) Date of Patent: May 2, 2023

(54) LOCKING ASSEMBLY FOR IN-VEHICLE VACUUM CLEANER

(71) Applicant: SHOP VAC CORPORATION, Williamsport, PA (US)

(72) Inventor: Jason Gottschall, South Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 431 days.

(21) Appl. No.: 16/825,463

(22) Filed: Mar. 20, 2020

(65) Prior Publication Data

US 2020/0297176 A1 Sep. 24, 2020

Related U.S. Application Data

(60) Provisional application No. 62/822,595, filed on Mar. 22, 2019.

(51) Int. Cl.

| | |
|---|---|
| ***A47L 9/14*** | (2006.01) |
| ***A47L 7/00*** | (2006.01) |
| ***A47L 5/24*** | (2006.01) |

(52) U.S. Cl.

CPC ..... *A47L 9/1472* (2013.01); *A47L 5/24* (2013.01); *A47L 7/0076* (2013.01)

(58) Field of Classification Search

CPC ..... A47L 9/00; A47L 9/14; A47L 5/24

See application file for complete search history.

(56) References Cited

U.S. PATENT DOCUMENTS

| | | | | |
|---|---|---|---|---|
| 10,099,659 | B1 | 10/2018 | Williams et al. | |
| 2018/0272954 | A1* | 9/2018 | Yurko | A47L 7/0076 |
| 2020/0101946 | A1* | 4/2020 | Gottschall | A47L 7/0076 |

* cited by examiner

*Primary Examiner* — Michael D Jennings

(74) *Attorney, Agent, or Firm* — Marshall, Gerstein & Borun LLP

(57) ABSTRACT

A vacuum cleaner configured to be mounted in a vehicle. The vacuum cleaner including a vacuum module configured to draw a vacuum, and a collector module configured to collect debris and coupled to the vacuum module. The collector module has a canister sub-assembly. A locking assembly for the canister sub-assembly includes at least one latch stay, a latch adapted to contact the latch stay, and a latch lock having a latch lock blade. The latch lock is moveable between a fully closed position, in which the latch lock blade contacts a panel member to maintain engagement between the latch and the at least one latch stay, and a fully open position. In the fully open position, the latch is disengaged from the at least one latch stay, enabling the canister sub-assembly to be removed from the collector module.

24 Claims, 9 Drawing Sheets

LOCKING ASSEMBLY FOR IN-VEHICLE VACUUM CLEANER

CROSS-REFERENCE TO RELATED APPLICATIONS

This application claims the benefit of U.S. Provisional Application No. 62/822,595 filed Mar. 22, 2019. The entire contents of this application are incorporated herein by reference in their entirety.

FIELD OF THE INVENTION

The present invention relates generally to a vacuum cleaner configured to be mounted in a vehicle and, more particularly, to a locking assembly for the same.

BACKGROUND

In order to clean a vehicle, such as a car or truck, a vacuum cleaner is often used to vacuum out dirt and debris. However, it can be awkward and/or inconvenient to use a typical in-home vacuum cleaner to clean out the interior of a vehicle. To address this inconvenience, attempts have been made to permanently install on-board vehicle vacuum cleaners inside the vehicle. However, the known on-board vehicle vacuum cleaners typically have a complex and dedicated installation arrangement, which limits the usage across different vehicles and/or in different arrangements within a vehicle. Further, once installed, some components of the vacuum cleaners move around during vehicle use and/or are not adequately secured, increasing risk that debris from the vacuum cleaner may be unintentionally spilled in the vehicle.

In addition, removal of the vacuum cleaner in a dedicated installation arrangement within the vehicle may be time consuming and difficult. For example, it is often difficult for users to access one or more devices or parts used to help remove the vacuum cleaner from a desired location, such as to remove debris collected in the vacuum cleaner, particularly without spilling the debris. In addition, while some parts may be relatively accessible, they can be heavy or cumbersome to handle, further adding to the difficulties in removing such vacuum cleaners from various positions within a vehicle.

SUMMARY OF THE DISCLOSURE

In accordance with a first exemplary aspect of the disclosure, a vacuum cleaner configured to be mounted in a vehicle comprises a vacuum module configured to draw a vacuum, and a collector module configured to collect debris and coupled to the vacuum module, the collector module having a canister sub-assembly. The vacuum cleaner further includes a locking assembly for the canister sub-assembly and the locking assembly comprises at least one latch stay, a latch, and a latch lock having a latch lock blade. The latch lock is moveable between a fully closed position, in which the latch lock blade contacts a panel member to maintain engagement between the latch and the at least one latch stay, and a fully open position. In the fully open position, the latch is disengaged from the at least one latch stay, enabling the canister sub-assembly to be removed from the collector module.

In accordance with a second exemplary aspect of the disclosure, a vacuum cleaner configured to be mounted in a vehicle comprises a vacuum unit configured to draw a vacuum, and a collector configured to collect debris and coupled to the vacuum unit. The collector includes a canister sub-assembly including a canister with a lid having a tab, and the canister includes a housing defining a cavity and a filter removably disposed in the cavity. An interlock assembly having a filter interlock is disposed adjacent to a side of the filter disposed in the canister of the collector. So configured, the filter contacts the filter interlock, preventing the tab of the lid from contacting the filter interlock and allowing the lid to completely close.

In accordance with yet another exemplary aspect of the disclosure, a vacuum cleaner configured to be mounted in a vehicle comprises a vacuum unit configured to draw a vacuum, and a collector configured to collect debris and coupled to the vacuum unit. The collector includes a canister sub-assembly, and a locking assembly is adapted to secure the canister sub-assembly within the collector. The locking assembly comprises at least one latch stay, a latch, and a latch lock having a latch lock blade. So configured, the latch lock is moveable between a fully closed position, in which the latch lock blade maintains engagement between the latch and the at least one latch stay, and a fully open position. In the fully open position, the latch is disengaged from the at least one latch stay, enabling the canister sub-assembly to be removed from the collector.

In further accordance with any one or more of the exemplary aspects, the vacuum cleaner optionally may include any one or more of the following preferred forms.

In some preferred forms, the collector module may further comprise a mounting plate, and the at least one latch stay is disposed on the mounting plate. In addition, the at least one latch stay may comprise a pair of latch stays disposed on the mounting plate, and the latch may contact each latch stay of the pair of latch stays when the latch lock is in the fully closed position. Further, the latch lock is disposed perpendicular to a lateral axis of the latch in the fully closed position. Also, the latch lock is disposed parallel to the lateral axis of the latch in the fully open position and the latch lock blade does not contact the panel member in the fully open position.

In other preferred forms, the latch may include a central portion having a first side and a second side, a first shoulder extending from the first side and contacting a first end of the mounting plate, and a second shoulder extending from the second side and contacting a second end of the mounting plate. The latch lock may be disposed on the central portion of the latch. In addition, the central portion may further include two downwardly and inwardly extending projections and a gripping portion integral with and disposed between both of the downwardly and inwardly extending projections. The gripping portion is adapted to be pulled when the latch lock is in the open position. Further, the first shoulder may engage a first latch stay disposed on the first end of the mounting plate, and the second shoulder may engage a second latch stay disposed on the second end of the mounting plate when the latch lock is in the fully closed position.

In still other preferred forms, the canister sub-assembly includes a canister with a lid having a tab, and the canister includes a housing defining a cavity. A filter may be removably disposed in the cavity, and a filter interlock may be disposed adjacent to a side of the filter, such that the filter contacts the filter interlock. This prevents the tab on the lid from contacting the filter interlock and allows the lid to completely close. An interlock spring may interact with the filter interlock and bias the filter interlock toward a center area of the cavity. So configured, the tab on the lid contacts the filter interlock when the filter is removed from the cavity, preventing the lid from completely closing.

In other preferred forms, the housing may include sides and a wall extending from one side of the housing to divide the cavity into a first cavity and a second cavity. The filter interlock may be disposed on the wall, such as an inside surface of the wall, and the interlock spring may be disposed between the wall and the filter interlock. The filter is adapted to be removably disposed in the first cavity. An interlock spring may be disposed between the inside surface of the wall and the filter interlock, biasing the filter interlock toward a center area of the first cavity. So configured, when the filter is not disposed in the cavity, the interlock spring moves the interlock toward a center area of the cavity, such that the tab on the lid contacts the interlock and prevents the lid from completely closing.

In still other preferred forms, the vacuum cleaner may include a locking assembly coupling the canister sub-assembly to the collector. The locking assembly may comprise at least one latch stay, a latch, and a latch lock having a latch lock blade adapted to contact a panel member to engage the at least one latch stay to the latch. In addition, the latch lock is moveable between a fully closed position, in which the latch lock blade contacts the panel member to maintain engagement between the latch and the at least one latch stay, and a fully open position. In the fully open position, the latch lock blade does not contact the panel member, and the latch is disengaged from the at least one latch stay, enabling the canister sub-assembly to be removed from the collector.

Additional optional aspects, arrangements, forms, and/or advantages of the vacuum cleaners disclosed herein will be apparent upon consideration of the following detailed description and the appended drawings, each different functionally operable and technically effective combination of which is expressly included as a part of the present disclosure.

BRIEF DESCRIPTION OF THE DRAWINGS

The Figures described below depict various aspects of the system and methods disclosed therein. It should be understood that each figure depicts an example of a particular aspect of the disclosed system and methods, and that each of the figures is intended to accord with a possible example thereof. Further, wherever possible, the following description refers to the reference numerals included in the following figures, in which features depicted in multiple figures are designated with consistent reference numerals.

There are shown in the drawings arrangements which are presently discussed, it being understood, however, that the present examples are not limited to the precise arrangements and instrumentalities shown, wherein.

DETAILED DESCRIPTION

A vacuum cleaner configured to be mounted in a vehicle is disclosed. The vacuum cleaner includes a vacuum module configured to draw a vacuum and a collector module configured to collect debris and coupled to the vacuum module. The collector module has a canister sub-assembly. In addition, a locking assembly secures the canister sub-assembly to the collector module and includes a latch stay, a latch to contact the latch stay, and a latch lock. The latch lock has a latch blade that maintains engagement between the latch and the latch stay when the latch lock is in a fully closed position. The latch lock is moveable between the fully closed position, in which the latch blade contacts a panel member of the collector module to maintain engagement between the latch and the latch stay, and a fully open position. In the fully open position, the latch blade is removed from contact with the panel member, and the latch is disengaged from the latch stay. As a result, the canister sub-assembly is able to be easily removed from the collector module for emptying. Likewise, the canister sub-assembly is able to be easily reinserted back into the collector module after emptying, and the latch lock moved back to a fully closed position. This easily secures the canister sub-assembly within the collector module before another use of the vacuum cleaner.

Figure 1:
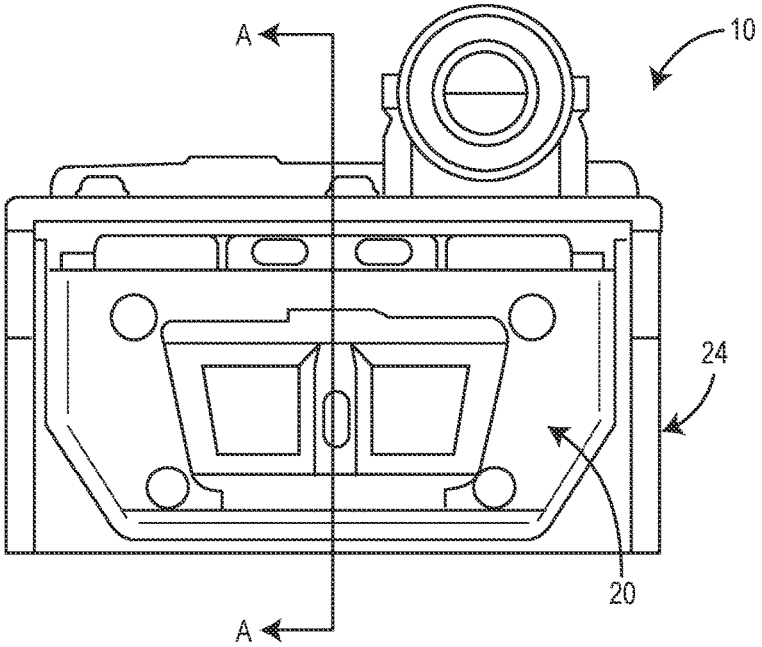
FIG. 1 is front view of a vacuum cleaner according to an aspect of the present disclosure, the vacuum cleaner having a latch lock in a closed position.
Figure 2:
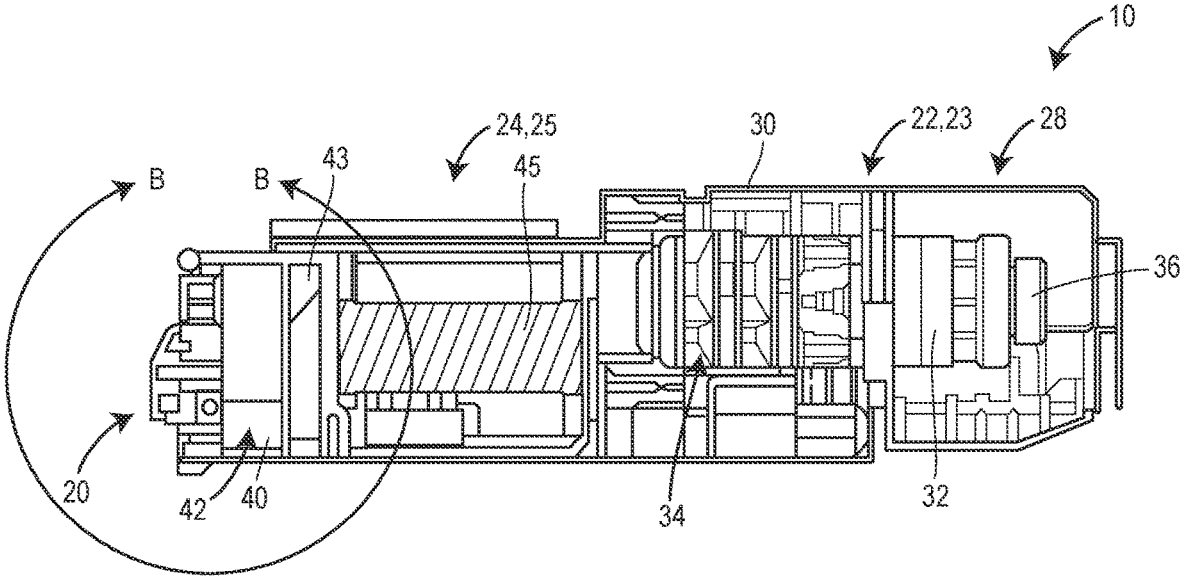
FIG. 2 is a sectional view of the vacuum cleaner of FIG. 1 taken along the line A-A of FIG. 2.

Referring now to FIGS. 1-2, a vacuum cleaner 10 having a locking assembly 20 according the present disclosure is depicted. The vacuum cleaner 10 is configured to be installed and operated within a vehicle, such as a car or truck or other type of vehicle. Preferably, the vacuum cleaner 10 is configured to be installed within a passenger compartment of the vehicle to provide easy access and use of the vacuum cleaner for cleaning the interior of the passenger compartment.

In one example, the vacuum cleaner 10 has a modular configuration. The modular configuration includes a vacuum module 22 and a collector module 24 that can be connected to each other as an integrated unit in any of a plurality of different pre-defined assembly arrangements, such as with an interconnecting duct (not depicted) or other coupling mechanism. For example, FIG. 2 depicts the vacuum cleaner 10 with the collector module 24 operatively connected to the vacuum module 22 in an in-line configuration. However, various other configurations may alternatively be employed, such as a side-by-side configuration or an upright installation configuration, and still fall within the scope of the present disclosure.

Because of its modular configuration, the vacuum cleaner 10 can be easily assembled and/or oriented in many different shapes and orientations. As a result, one can easily configure the vacuum cleaner 10 to fit different shapes and/or configurations of receptacle spaces within a vehicle, while maintaining the vacuum cleaner 10 as an integrated unit. For example, the vacuum cleaner 10 may be configured and oriented to fit in a space between seats, such as within a center console. Alternatively, the vacuum cleaner 10 may be configured and oriented to fit on the side or underneath a seat, in a space along the side wall of a cargo bay of a van or sport utility vehicle (SUV), in a passenger compartment or in the trunk. However, because the interconnecting duct or other coupling mechanism operatively couples the collector module 24 to the vacuum module 22 in pre-defined orientations as an integral unit, the vacuum cleaner 10 can be easily installed and/or removed and/or otherwise moved around as a single unit, which may provide easier handling of the vacuum cleaner 10 as compared to a vacuum cleaner that is not connected together as an integrated unit. When the collector module 24 is operatively coupled to the vacuum module 22, air can be drawn from the interior of the collector module 24 into the interior of the vacuum module 22, for example, by a motor of the vacuum module 22, as explained more below.

Alternatively, the vacuum cleaner 10 may not include a modular configuration and still fall within the scope of the present disclosure. For example, the vacuum cleaner 10 may include a vacuum unit 23 and a collector 25 that still are coupled to each other to form an integrated vacuum cleaner unit. While the vacuum cleaner 10 may not include all of the various modular arrangements in this example, the vacuum cleaner 10 may still be configured and oriented to fit in various spaces within a vehicle.

Referring now to FIG. 2, the vacuum module 22 includes a motor/impeller unit 28 within a motor housing 30. The motor housing 30 has an outer shell with a generally elongate rectangular form. However, the motor housing 30 may take many different forms and shapes and sizes depending upon the particular space needs and/or arrangements desired for installation in a particular vehicle and still fall within the scope of the present disclosure. The motor/impeller unit 28 includes a motor 32 that drives an impeller assembly 34, and a controller 36 that controls the motor 32. The motor 32 can be of any design suitable for vacuum cleaners, including standard motors with brushes or brushless motors, and switched reluctance motors. The impeller assembly 34 may take any form suitable for moving air in a manner that will create a vacuum. In this arrangement, the impeller assembly 34 includes three in-line impellers. However, other forms of the impeller assembly 34 may also be used. The motor 32 is operatively coupled to the impeller assembly 34 to drive the impellers to create a vacuum. The controller 36 includes suitable electronics, such as a PCB board and/or other appropriate electronic control circuits configured to control the motor 32. The motor housing 30 includes an intake opening (not depicted) that forms a duct receiver and an air inlet for air that is drawn into the impeller assembly.

Figure 11:
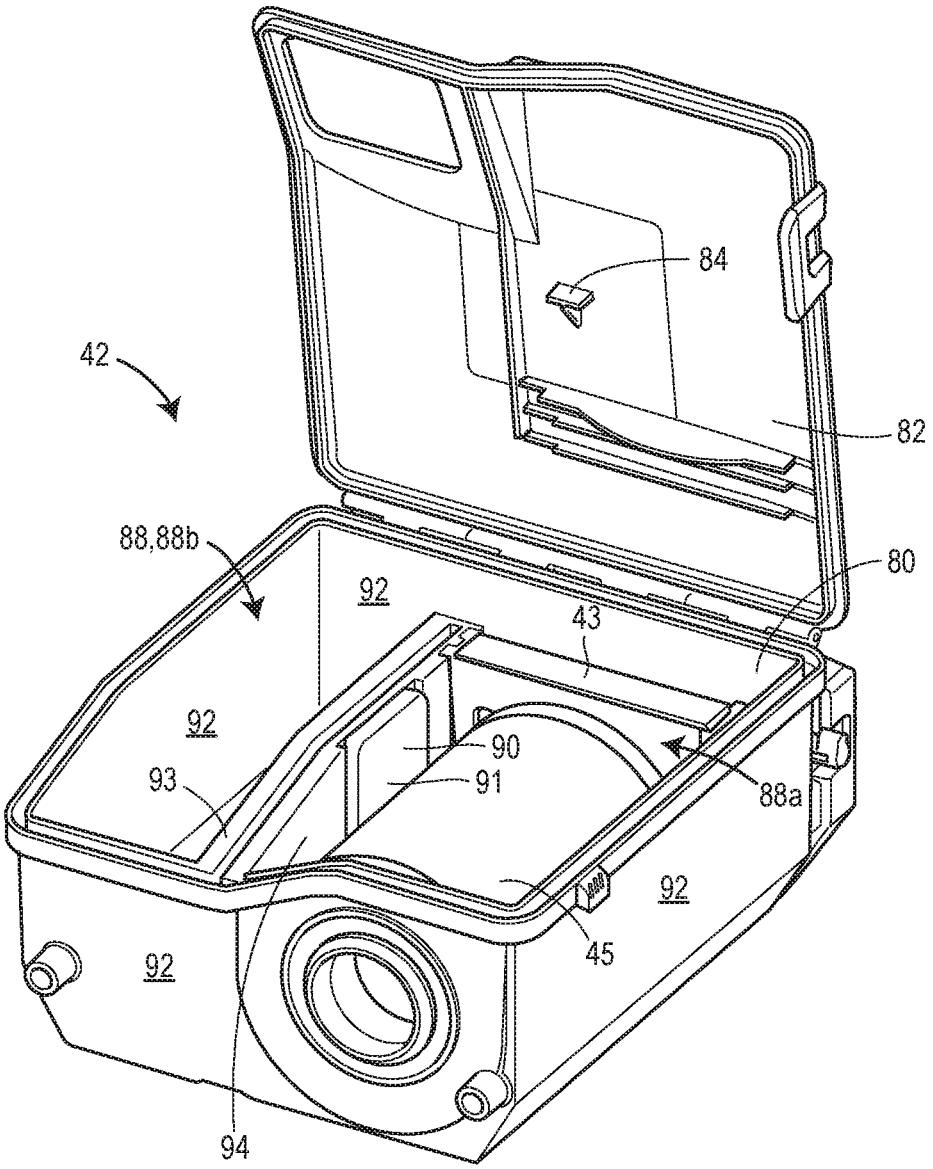
FIG. 11 is a rear perspective view of a portion of a vacuum cleaner, such as the vacuum cleaner of FIG. 1, according to another aspect of the present disclosure.

Still referring to FIG. 2, the collector module 24 includes a housing 40 and a canister sub-assembly 42 disposed within the housing 40. The canister sub-assembly 42 also includes a pre-filter 43 and a filter 45, as explained more below (FIG. 11). The canister sub-assembly 42 is removably received within the housing 24 such that the canister sub-assembly 42 can be slidably removed from and returned into the housing 40.

Figure 3:
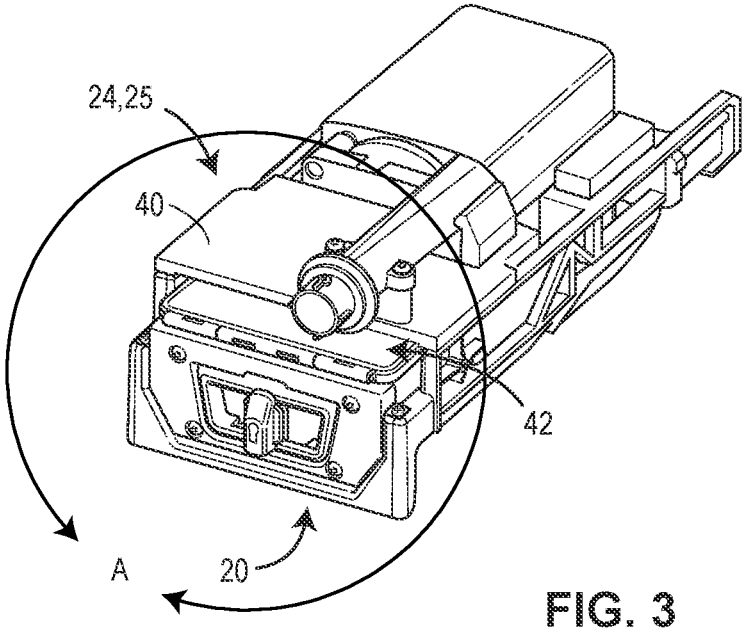
FIG. 3 is a front perspective view of a portion of the vacuum cleaner of FIG. 1.
Figure 4:
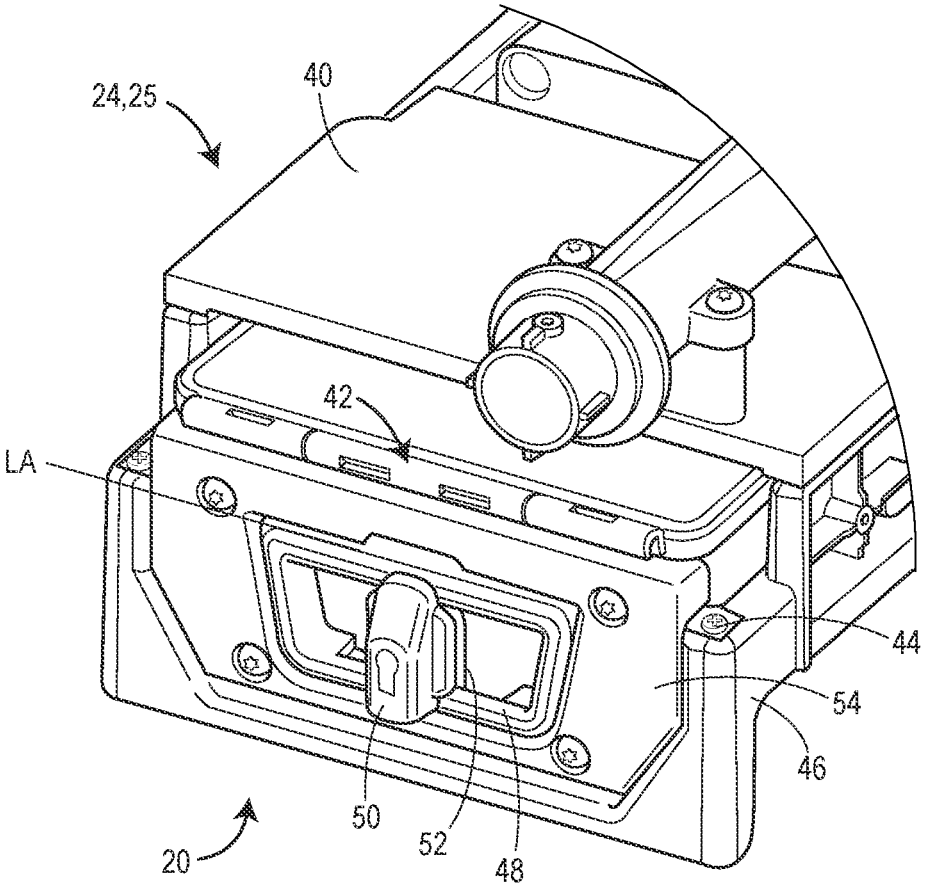
FIG. 4 is a close-up view of a portion A of the vacuum cleaner of FIG. 3.
Figure 5:
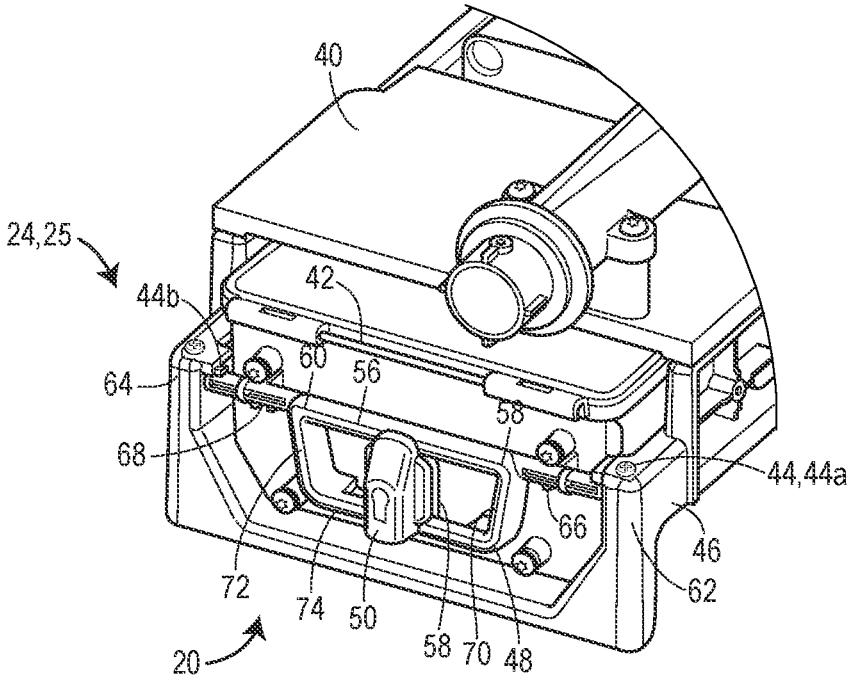
FIG. 5 is another close-up view of the portion A of the vacuum cleaner of FIG. 3, with a front panel removed from the vacuum cleaner.

Referring now to FIGS. 3 and 4, the locking assembly 20 for the canister sub-assembly 42 of the vacuum cleaner 10 is further depicted. More specifically, and in one example, the locking assembly 20 includes at least one latch stay 44. The at least one latch stay 44 is disposed on a mounting plate 46 attached to a portion of the housing 40 of the collector module 24, as depicted in FIG. 4. In another example, and as depicted in FIG. 5, the at least one latch stay 44 includes a pair of latch stays 44*a*, 44*b*, such as a first latch stay 44*a* and a second latch stay 44*b*, disposed on the mounting plate 46, as explained more below. The locking assembly 20 further includes a latch 48 adapted to contact the at least one latch stay 44, and a latch lock 50 having a latch lock blade 52. A panel member 54 is disposed one or more of around and/or over the latch 48, as depicted in FIG. 4, for example. In this example, the panel member includes a centrally located recess, such that the latch 48 is accessible through the recess when the panel member 54 is included.

Figure 8:
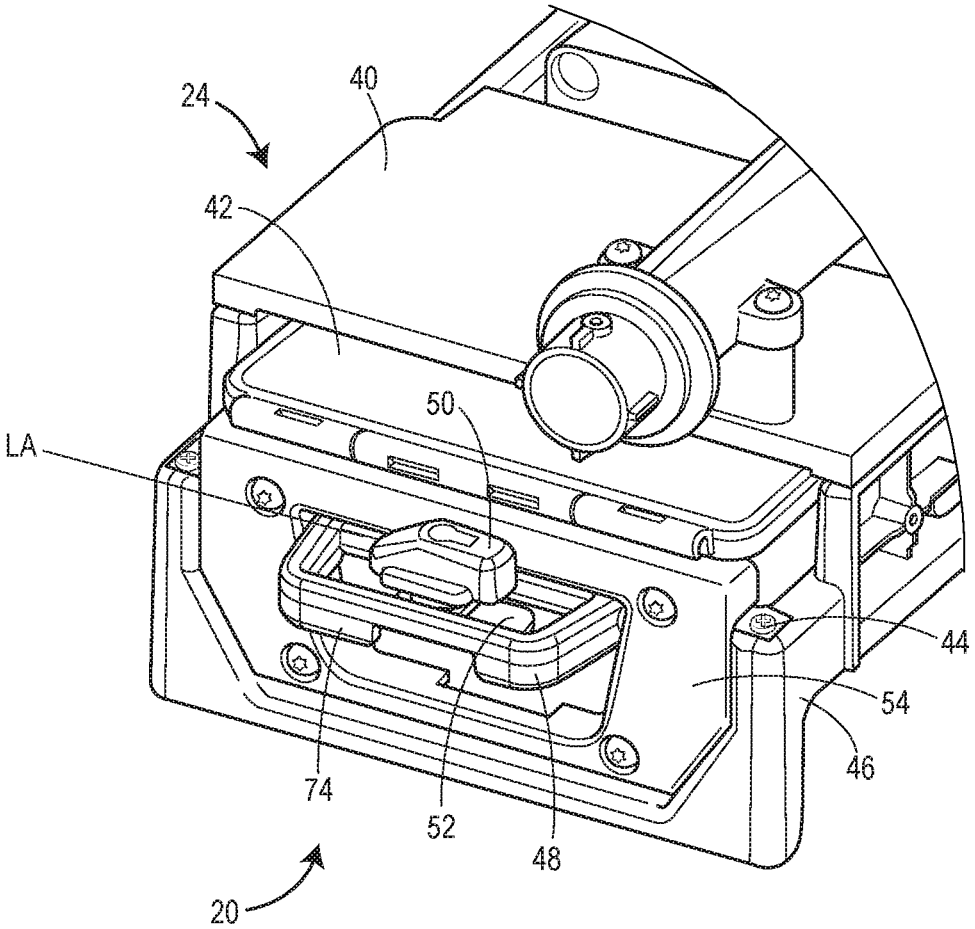
FIG. 8 is a close-up view of a portion C of the vacuum cleaner of FIG. 7.
Figure 9:
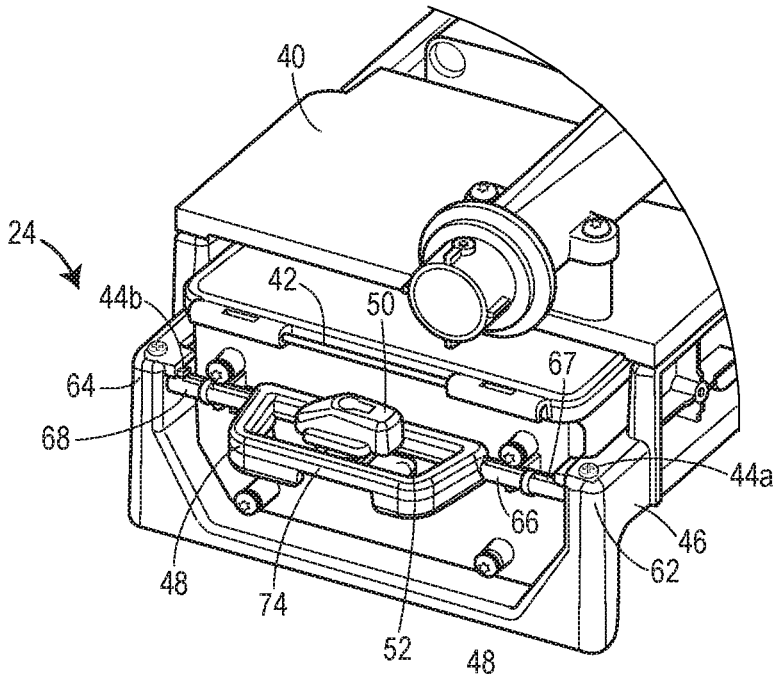
FIG. 9 is another close-up view of the portion C of the vacuum cleaner of FIG. 7, with the front panel removed from the vacuum cleaner of FIG. 7.

So configured, the latch lock 50 is moveable between a fully closed position, as depicted in FIG. 4, for example, and a fully open position, as depicted in FIG. 8-9, for example. More specifically, when the latch lock 50 is in the fully closed position, the latch lock blade 52 contacts the panel member 54 to maintain engagement between the latch 48 and the at least one latch stay 44. When the latch lock 50 is in the fully open position, the latch lock blade 52 does not contact the panel member 54 and the latch 48 is disengaged from the at least one latch stay 44, as explained more below. As a result, the canister sub-assembly 42 is able to be removed from the collector module 24 for emptying. In addition, the latch 48 includes a lateral axis LA, and the latch lock 50 is disposed perpendicular to the lateral axis LA of the latch 48 when the latch lock 50 is in a fully closed position.

Referring now to FIG. 5, the panel member 54 is removed from the collector module 24 and further features of the latch 48 and collector module 24 are depicted. For example, and in one example, the latch 48 includes a central portion 56 having a first side 58 and a second side 60. The latch lock 50 is disposed at the central portion 56 of the latch 48. In addition, the mounting plate 46 includes a first end 62 and a second end 64, such that the first latch stay 44*a* is disposed on the first end 62 of the mounting plate 46 and the second latch stay 44*b* is disposed on the second end 64 of the mounting plate 46.

The latch 48 also includes a first shoulder 66 extending from the first side 58 of the latch 48 and contacting the first end 62 of the mounting plate 46. A second shoulder 68 extends from the second side 60 of the latch 48 and contacts the second end 64 of the mounting plate 46. In one example, and when the latch lock 50 is in the fully closed position, the first shoulder 66 contacts the first latch stay 44*a* at the first end 62 of the mounting plate 46. In addition, the second shoulder 68 of the latch 48 contacts the second latch stay 44*b* at the second end 64 of the mounting plate 46.

The central portion 56 of the latch 48 further includes two downwardly and inwardly extending projections 70, 72 and a gripping portion 74. The gripping portion 74 is integral with and disposed between the two downwardly and inwardly extending projections 70, 72, as depicted in FIG. 5, for example. When the latch lock 50 is moved to the fully open position (e.g., FIGS. 8-9), the gripping portion 74 is completely accessible and capable of being pulled, which helps enable the canister sub-assembly 42 to be removed from the collector module 24 for emptying.

Figure 6:
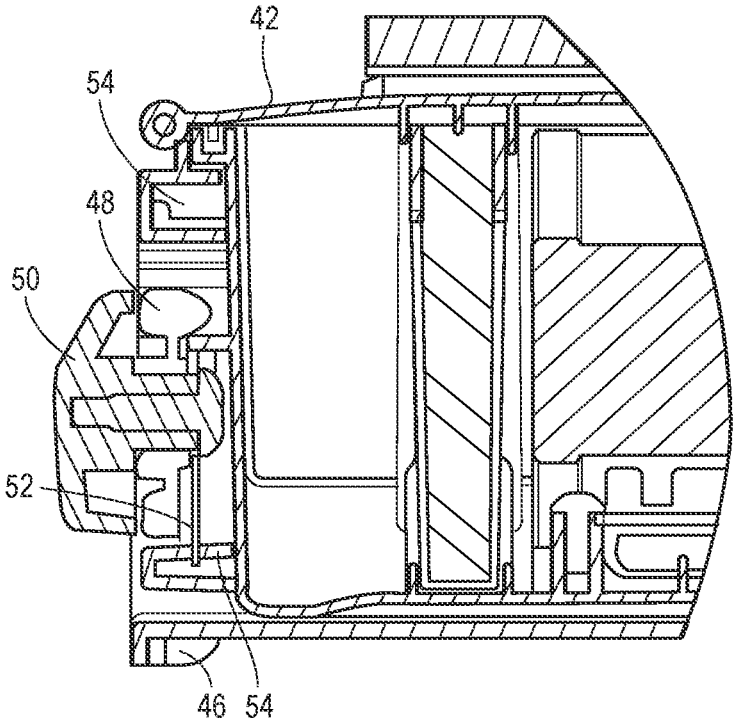
FIG. 6 is a portion B of the vacuum cleaner of FIG. 2.
Figure 7:
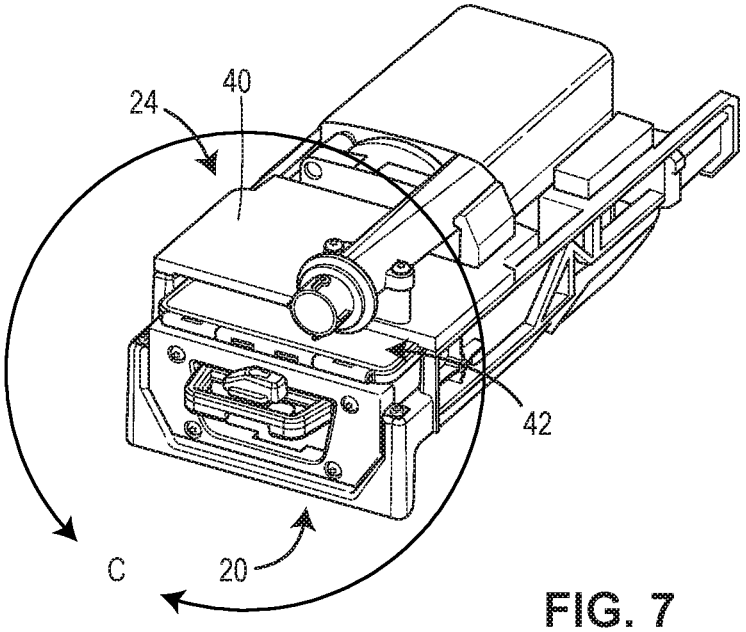
FIG. 7 is a front perspective view of the vacuum cleaner of the present disclosure, the latch lock of the vacuum cleaner in an open position.

Referring now to FIG. 6, a cross-sectional view of a portion B of the collector module 24 of FIG. 2 is depicted. The latch lock 50 is in the fully closed position, and the latch lock blade 52 of the latch lock 50 contacts the panel member 54 to maintain engagement between the latch 48 and the at least one latch stay 44 (FIG. 5). In one example, the latch lock 50 contacts the panel member 54 to maintain engagement between both the first shoulder 66 of the latch 48 and the first latch stay 44*a* and the second shoulder 68 of the latch 48 and the second latch stay 44*b*.

Referring now to FIGS. 7-10, the latch lock 50 of the locking assembly 20 is disposed in a fully open position. In the fully open position, the latch lock 50 has been moved from a position perpendicular to the lateral axis LA of the latch 48 to a position parallel to the lateral axis LA of the latch 48, as depicted in FIG. 8, for example. Said another way, the latch lock 50 may be rotated 90 degrees counter-clockwise from the fully closed position in which the latch lock 50 is disposed perpendicular to the lateral axis LA of the latch 48 to the fully open position, in which the latch lock 50 is disposed parallel to the lateral axis LA of the latch 48. Alternatively, the latch lock 50 may be moved and/or rotated in another direction to reach the fully open position and still fall within the scope of the present disclosure.

Figure 10:
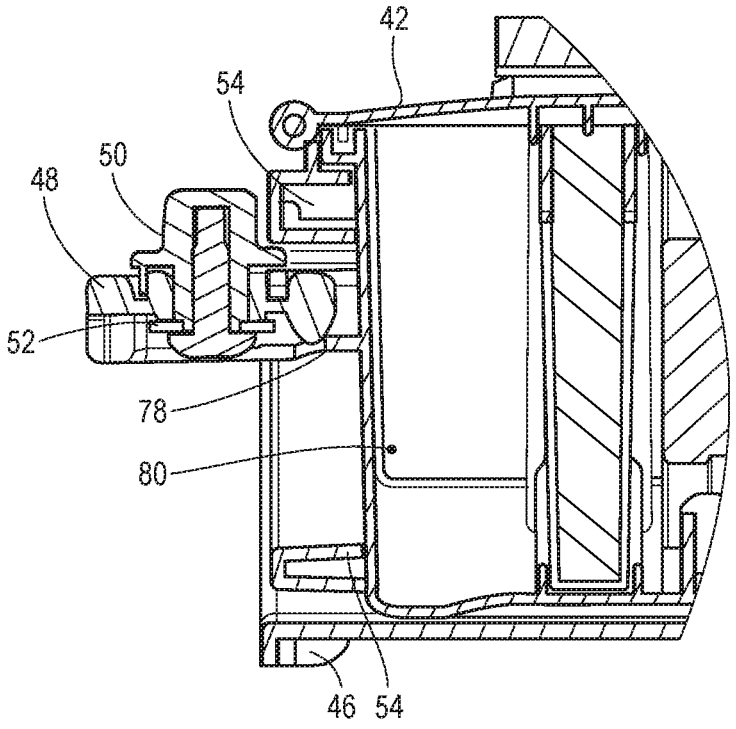
FIG. 10 is a close-up view of a portion of a sectional view of the vacuum cleaner of FIG. 7, with the latch lock in the open position.

After moving the latch lock 50 to the fully open position, the latch 48, such as the gripping portion 74 may be moved and/or rotated from a vertical position (FIGS. 4 and 5) to a horizontal position, as depicted in FIGS. 8-10. The gripping portion 74 may then be pulled in a direction away from the collector module 24 to remove the canister sub-assembly 42 from the collector module 24 for emptying debris disposed therein.

Referring now to FIG. 9, a portion of the collector module 24 is depicted with the panel member 54 removed from the collector module 24 and the latch lock 50 still in a fully open position. In the fully open position, the latch 48 is disengaged from the at least one latch stay 44. More specifically, and in one example, the first shoulder 66 of the latch 48 is not engaged with the first latch stay 44*a*, and the second shoulder 68 of the latch 48 is not engaged with second latch stay 44*b*. In particular, the first shoulder 66 includes a recess 67 and the second shoulder 68 includes a recess 69, such that when the latch 48 is moved from the vertical position (e.g., FIG. 4) to the horizontal position (e.g., FIG. 9) each of the first and second shoulders 66, 68 rotate. The corresponding recesses 67, 69 align with each corresponding latch stay 44*a*, 44*b*, preventing engagement between the first and second shoulders 66, 68 and the first and second latch stays 44*a*, 44*b*.

Referring now to FIG. 10, another cross-sectional view of a portion of the collector module 24 is depicted, with the latch lock 50 in the fully open position and the latch 48 moved to a horizontal position. So positioned, the latch lock blade 52 no longer contacts the panel member 54, and the latch 48 is disengaged from the at least one latch stay 44. Further, a tab 78 of a canister 80 of the canister sub-assembly 42 holds the latch 48 in the horizontal position depicted in FIGS. 7-10.

Figure 12:
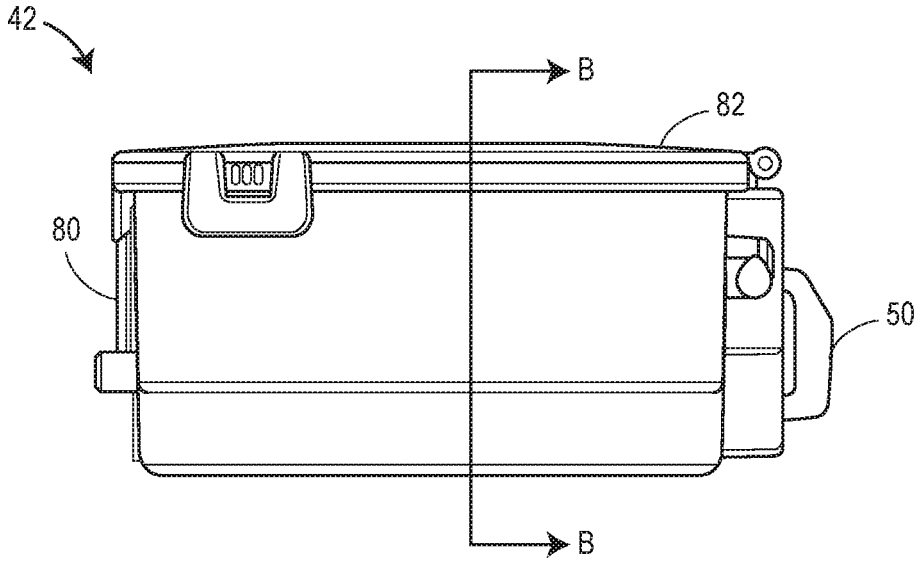
FIG. 12 is a side view of the portion of the vacuum cleaner of FIG. 11.
Figure 13:
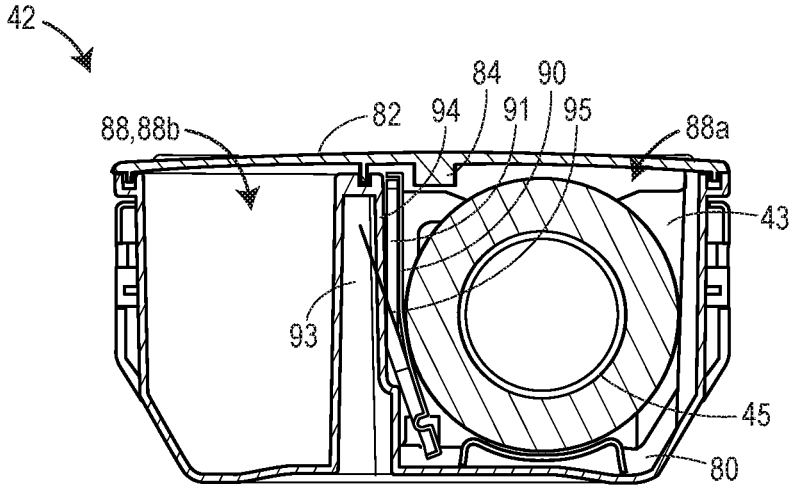
FIG. 13 is a sectional view of the portion of the vacuum cleaner of FIG. 12 taken along the line B-B of FIG. 12.

Referring now to FIGS. 11-13, the canister sub-assembly 42 of the collector module 24 of FIGS. 1-10 is depicted. While the canister sub-assembly 42 of the collector module 24 is coupled to the vacuum module 22 of FIG. 2, for example, the canister sub-assembly 42 may alternatively be coupled to another vacuum source including a motor and still fall within the scope of the present disclosure. Said another way, the collector module 24 may be a collector having the canister sub-assembly 42 coupled to the vacuum unit without any modular configuration. As noted above, such an alternative arrangement still falls within the scope of the present disclosure.

As shown therein, the canister sub-assembly 42 includes the canister 80, the pre-filter 43, and the filter 45. The canister 80 includes a lid 82 having a tab 84 and a housing 86 defining a cavity 88. Both the pre-filter 43 and the filter 45 are removably disposed within the cavity 86 of the housing 84.

An interlock assembly 90 includes a filter interlock 91 disposed adjacent to a side of the filter 45. So configured, the filter 45 contacts the filter interlock 91, which prevents the tab 84 of the lid 82 from contacting the filter interlock 91. As a result, the lid 82 is able to completely close, as depicted in FIG. 13. As depicted in FIG. 11, the housing 86 includes sides 92, such as four sides 92. The housing 86 may alternatively have fewer or more sides 92 and still fall within the scope of the present disclosure. A wall 93 extends from one side 92 of the housing 86 to divide the cavity 88 of the housing 86 into a first cavity 88*a* and a second cavity 88*b*. The filter 45 is adapted to be disposed in the first cavity 88*a* and the filter interlock 91 is disposed on an inside surface 94 of the wall 93.

Figure 14:
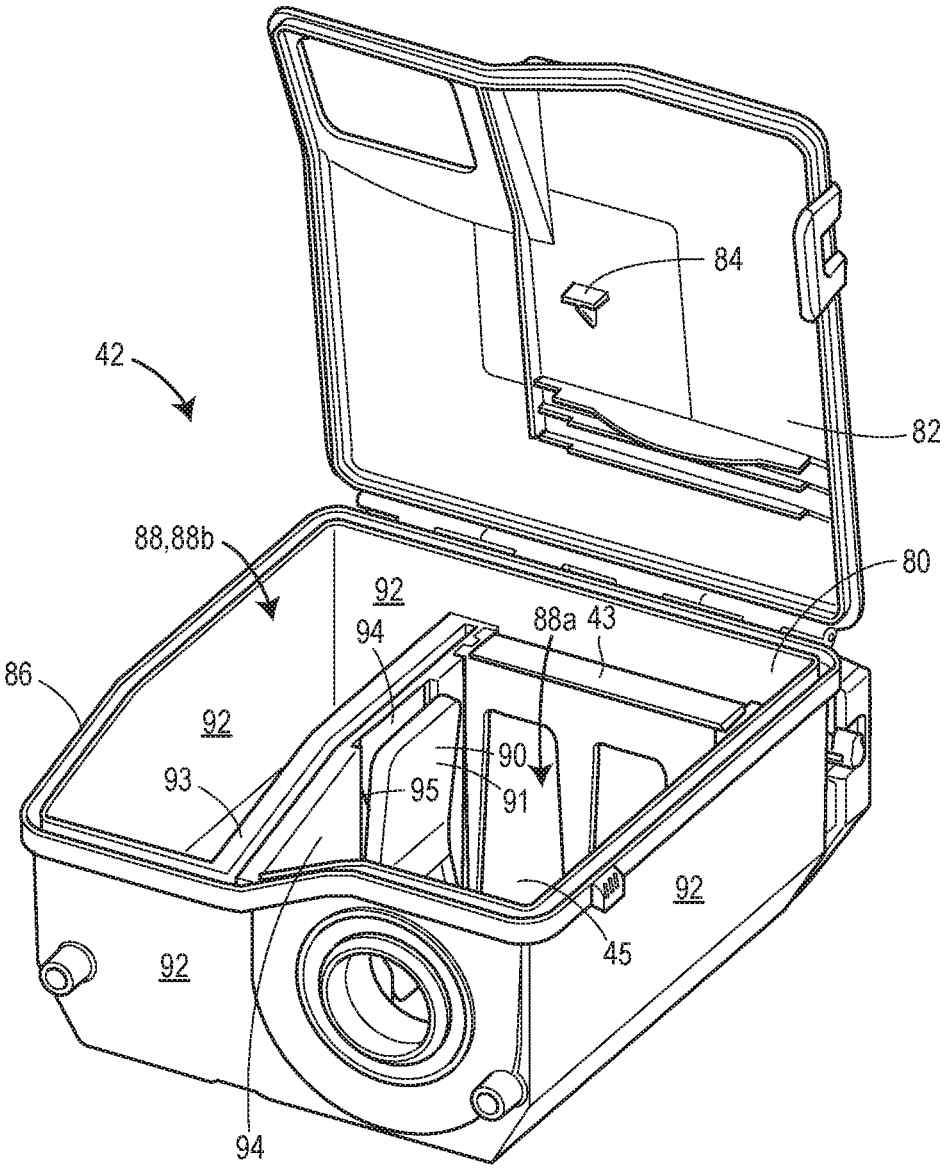
FIG. 14 is another rear perspective view of a portion of the vacuum cleaner of FIG. 1, with a filter removed from the portion of the vacuum cleaner.

The interlock assembly 90 further includes an interlock spring 95 disposed between the inside surface 94 of the wall 93 and the filter interlock 91, as best depicted in FIGS. 13 and 14, for example. In one example, the interlock spring 95 is a steel spring or a portion of a steel spring. Alternatively, the interlock spring 95 may take various other forms and still fall within the scope of the present disclosure. In another example, the interlock spring 95 may be preloaded when installed in the canister 86 and will not have a bend to at least a portion of the interlock spring 95.

Figure 15:
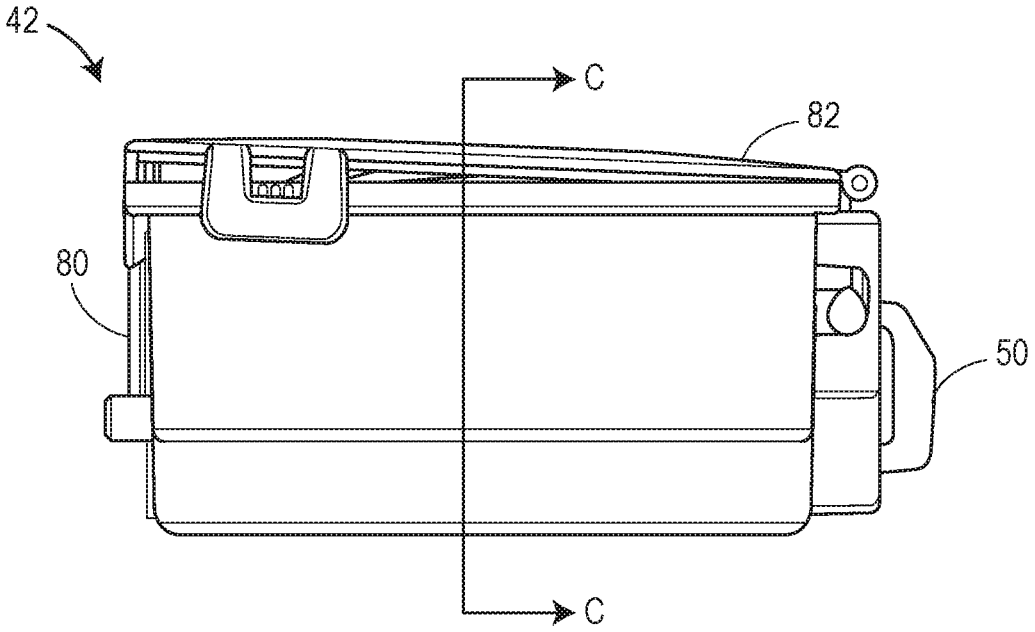
FIG. 15 is a side view of the portion of the vacuum cleaner of FIG. 14.
Figure 16:
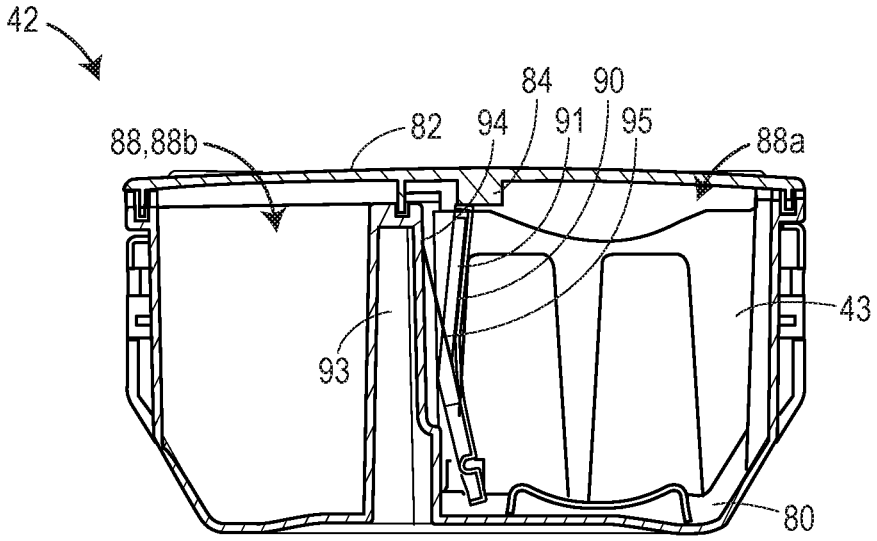
FIG. 16 is a sectional view of the portion of the vacuum cleaner of FIG. 15 taken along the line C-C of FIG. 15.

Referring now to FIGS. 14-16, the canister sub-assembly 42 is depicted without the filter 45 disposed within the cavity 88, 88*a* of the canister 86. The interlock spring 95 biases the filter interlock 91 toward a center area of the first cavity 88*a*, as depicted in FIG. 14, for example. Said another way, when the filter 45 is not disposed in the cavity 88*a* of the canister 86, the interlock spring 95 moves the filter interlock 91 toward the center area of the cavity 88*a*. As a result, the tab 84 of the lid 82 contacts the filter interlock 91, as depicted in FIG. 16 when the lid 82 is moved to a closed position, preventing the lid 82 from completely closing.

In view of the foregoing, the vacuum cleaner 10 has several advantages. The unique locking assembly 20 disposed on the collector module 24 secures the canister sub-assembly 32 to the collector module 24 once installed within a vehicle, for example. As a result, the canister sub-assembly 42 moves very little, if at all, reducing if not eliminating the risk of debris (from the canister sub-assembly 42) spilling inside the vehicle during use of the vacuum cleaner 10 and/or the vehicle.

Further, the unique interlock assembly 90 secures the filter 45 within the canister sub-assembly 42, preventing movement of the same during use of the one or both of the vacuum cleaner 10 and/or the vehicle. Further, the lid 84 is able to completely close when the filter 45 is disposed therein in view of the interlock assembly 90, further reducing risk of debris spilling from the canister sub-assembly 42 during operation of the vacuum cleaner 10 and/or the vehicle. In addition, an advantage of the lid 84 not completely closing, such as when the filter 45 is not disposed within the canister sub-assembly 42, is the vacuum will not create any suction, preventing the user from sucking up any debris.

Still further, the shapes and sizes of the collector module 24 and the vacuum module 22 may be modified to conform to many different space configurations as may be dictated by the space and sizes of components within the vehicle and/or decorative design considerations. While it is anticipated the vacuum cleaner 10 will be configured for installation within the passenger and/or cargo compartment of the vehicle, the vacuum cleaner 10 may alternatively be configured for other areas of the vehicle, increasing the flexibility of the vacuum cleaner 10.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one example" or "an example" means that a particular element, feature, structure, or characteristic described in connection with the embodiment is included in at least one embodiment. The appearances of the phrase "in one example" in various places in the specification are not necessarily all referring to the same example.

Some examples may be described using the expression "coupled" and "connected" along with their derivatives. For example, some examples may be described using the term "coupled" to indicate that two or more elements are in direct physical or electrical contact. The term "coupled," however, may also mean that two or more elements are not in direct contact with each other, but yet still cooperate or interact with each other. The examples are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

While various embodiments have been described herein, it is understood that the appended claims are not intended to be limited thereto, and may include variations that are still within the literal or equivalent scope of the claims.

What is claimed:

1. A vacuum cleaner configured to be mounted in a vehicle, the vacuum cleaner comprising:

a vacuum module configured to draw a vacuum;

a collector module configured to collect debris and coupled to the vacuum module, the collector module having a canister sub-assembly; and a locking assembly for the canister sub-assembly, the locking assembly comprising at least one latch stay, a latch, and a latch lock having a latch lock blade;

where, the latch lock is moveable between a fully closed position, in which the latch lock blade contacts a panel member to maintain engagement between the latch and the at least one latch stay, and a fully open position, in which the latch is disengaged from the at least one latch stay, enabling the canister sub-assembly to be removed from the collector module.

2. The vacuum cleaner of claim 1, the collector module further comprising a mounting plate, and the at least one latch stay disposed on the mounting plate.

3. The vacuum cleaner of claim 2, wherein the at least one latch stay comprises a pair of latch stays disposed on the mounting plate, and the latch contacts each latch stay of the pair of latch stays when the latch lock is in the fully closed position.

4. The vacuum cleaner of claim 1, wherein the latch lock is disposed perpendicular to a lateral axis of the latch in the fully closed position, and the latch lock is disposed parallel to the lateral axis of the latch in the fully open position and the latch lock blade does not contact the panel member.

5. The vacuum cleaner of claim 1, wherein the latch includes a central portion having a first side and a second side, a first shoulder extending from the first side and contacting a first end of the mounting plate, and a second shoulder extending from the second side and contacting a second end of the mounting plate, and the latch lock is disposed on the central portion of the latch.

6. The vacuum cleaner of claim 5, wherein the central portion further includes two downwardly and inwardly extending projections and a gripping portion integral with and disposed between both of the downwardly and inwardly extending projections, the gripping portion adapted to be pulled when the latch lock is in the open position.

7. The vacuum cleaner of claim 5, wherein the first shoulder engages a first latch stay disposed on the first end of the mounting plate and the second shoulder engages a second latch stay disposed on the second end of the mounting plate when the latch lock is in the fully closed position.

8. The vacuum cleaner of claim 1, the canister sub-assembly including a canister with a lid having a tab, the canister including a housing defining a cavity, a filter removably disposed in the cavity, and a filter interlock disposed adjacent to a side of the filter, such that the filter contacts the filter interlock, preventing the tab on the lid from contacting the filter interlock and allowing the lid to completely close.

9. The vacuum cleaner of claim 8, further comprising an interlock spring interacting with the filter interlock, where the interlock spring biases the filter interlock toward a center area of the cavity, such that the tab on the lid contacts the filter interlock when the filter is removed from the cavity, preventing the lid from completely closing.

10. The vacuum cleaner of claim 8, the housing having sides and a wall extending from one side of the housing to divide the cavity, the filter interlock disposed on the wall, and the interlock spring disposed between the wall and the filter interlock.

11. A vacuum cleaner configured to be mounted in a vehicle, the vacuum cleaner comprising:

a vacuum unit configured to draw a vacuum;

a collector configured to collect debris and coupled to the vacuum unit, the collector having a canister sub-assembly including a canister with a lid having a tab, the canister including a housing defining a cavity and a filter removably disposed in the cavity; and an interlock assembly having a filter interlock disposed adjacent to a side of the filter disposed in the canister of the collector;

where the filter contacts the filter interlock, preventing the tab of the lid from contacting the filter interlock and allowing the lid to completely close.

12. The vacuum cleaner of claim 11, the housing having sides and a wall extending from one side of the housing to divide the cavity of the housing into a first cavity and a second cavity, the filter adapted to be removably disposed in the first cavity and the filter interlock disposed on an inside surface of the wall.

13. The vacuum cleaner of claim 12, further comprising an interlock spring disposed between the inside surface of the wall and the filter interlock, biasing the filter interlock toward a center area of the first cavity.

14. The vacuum cleaner of claim 11, further comprising an interlock spring wherein, when the filter is not disposed in the cavity, the interlock spring moves the interlock toward a center area of the cavity, such that the tab on the lid contacts the interlock, preventing the lid from completely closing.

15. The vacuum cleaner of claim 11, further comprising a locking assembly coupling the canister sub-assembly to the collector, the locking assembly comprising at least one latch stay, a latch, and a latch lock having a latch lock blade adapted to contact a panel member to engage the at least one latch stay to the latch.

16. The vacuum cleaner of claim 15, wherein the latch lock is moveable between a fully closed position, in which the latch lock blade contacts the panel member to maintain engagement between the latch and the at least one latch stay, and a fully open position in which the latch lock blade does not contact the panel member and the latch is disengaged from the at least one latch stay, enabling the canister sub-assembly to be removed from the collector.

17. The vacuum cleaner of claim 15, wherein the latch lock is disposed perpendicular to a lateral axis of the latch when the latch lock is in a fully closed position, and the latch lock is disposed parallel to the lateral axis of the latch when the latch lock is in a fully open position.

18. A vacuum cleaner configured to be mounted in a vehicle, the vacuum cleaner comprising:

a vacuum unit configured to draw a vacuum;

a collector configured to collect debris and coupled to the vacuum unit, the collector having a canister sub-assembly; and a locking assembly adapted to secure the canister sub-assembly within the collector, the locking assembly comprising at least one latch stay, a latch, and a latch lock having a latch lock blade;

where, the latch lock is moveable between a fully closed position, in which the latch lock blade maintains engagement between the latch and the at least one latch stay, and a fully open position, in which the latch is disengaged from the at least one latch stay, enabling the canister sub-assembly to be removed from the collector.

19. The vacuum cleaner of claim 18, the collector further comprising a mounting plate, and the at least one latch stay is disposed on the mounting plate and contacting the latch when the latch lock is in the fully closed position.

20. The vacuum cleaner of claim 19, wherein the mounting plate includes a first end and a second end, and the at least one latch stay comprises a first latch stay disposed on the first end of the mounting plate and a second latch stay disposed on a second end of the mounting plate, the latch contacting each of the first latch stay and the second latch stay when the latch lock is in the fully closed position.

21. The vacuum cleaner of claim 18, wherein the latch lock is disposed perpendicular to a lateral axis of the latch in the fully closed position, and the latch lock is disposed parallel to a lateral axis of the latch in the fully open position.

22. The vacuum cleaner of claim 18, the canister sub-assembly including a canister with a lid having a tab, the canister defining a cavity and having a filter removably disposed in the cavity and a filter interlock disposed adjacent to a side of the filter, the filter contacting the filter interlock, preventing the tab from contacting the filter interlock and allowing the lid to completely close.

23. The vacuum cleaner of claim 22, further comprising an interlock spring interacting with the filter interlock to bias the filter interlock toward a center portion of the cavity, such that the tab on the lid contacts the filter interlock when the filter is not disposed in the cavity, preventing the lid from completely closing.

24. The vacuum cleaner of claim 18, where the latch lock blade contacts a panel member when the latch lock is in the fully closed position, and the latch lock blade does not contact the panel member when the latch lock is in the fully open position.

* * * * *